US006683579B1

(12) United States Patent
Riveria

(10) Patent No.: US 6,683,579 B1
(45) Date of Patent: Jan. 27, 2004

(54) ANTENNA FOR SUBMARINE TOWED BUOY

(75) Inventor: David F. Riveria, Vernon, CT (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/267,097

(22) Filed: Oct. 8, 2002

(51) Int. Cl.[7] ..... H01Q 1/34
(52) U.S. Cl. ..... 343/709; 343/719; 340/984
(58) Field of Search ..... 343/709, 719, 343/700 MS; 340/984, 985; 441/11, 33

(56) References Cited

U.S. PATENT DOCUMENTS 4,227,479 A * 10/1980 Gertler et al. ..... 114/312
5,517,202 A * 5/1996 Patel et al. ..... 343/709
6,127,983 A * 10/2000 Rivera et al. ..... 343/767

* cited by examiner

*Primary Examiner*—James Clinger
(74) *Attorney, Agent, or Firm*—James M. Kasischke; Michael F. Oglo; Jean-Paul A. Nasser

(57) ABSTRACT

A compact antenna transmits and receives broadband electromagnetic energy signals over a 180° hemispherical pattern in air at the ocean's surface. The antenna has an elongate semi-cylindrical shell and a circular end disc connected to one end, and a semi-circular end disc connected to the other end to form a half-cylinder cavity. A curved plate is connected to the circular end disc and a curved body portion has a curved end extending parallel with the semi-cylindrical shell. A vertical stem has an upper portion connected to the curved plate. The semi-cylindrical shell, circular end disc, semi-circular end disc, and vertical stem are made from a material that is conductive of electromagnetic signals, and they can be differently dimensioned to change the center frequencies to embrace different broadband ranges. The antenna is deployed and retrieved from a submarine in a tow body.

20 Claims, 3 Drawing Sheets

ANTENNA FOR SUBMARINE TOWED BUOY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates generally to antennas. More particularly, this invention relates to an antenna in a buoy towed behind a submarine for communications with satellites.

(2) Description of the Prior Art

Communications between submersibles such as submarines and remote stations are in a continuous state of development to assure the reliable exchange of information. Transmitting messages acoustically often is not acceptable since this mode of transmission may introduce the problems associated with large systems operating in low ranges and covertness can be compromised at these and higher acoustic frequencies.

Bi-directional electromagnetic transmissions have been used with some success, but usually an antenna must extend through the water-air interface for successful operation. Unfortunately, the upwardly extending antennas can be detected by radar, visual and other means, to possibly reveal the presence of the submarine. Some antennas have been made to float on the surface of the water but still their size tends to make them detectable, and they are hard to deploy, retrieve, and stow from the limited spaces for stowage on submarines. In addition most, if not all of the antennas have non-uniform, or lobed radiation and detection patterns so that the submarine platform may miss or not complete some transmissions. This could require the submarine to change its course to reorient the antenna for desired transmission/reception qualities.

U.S. Pat. No. 5,517,202 to Jayant S. Patel et al. discloses a buoyant antenna-tow body structure that has an elongate cylindrical shell having a number of aligned sensor or antenna elements inside of it. The '202 structure may be relatively long and may create problems during stowage, launch, and retrieval on a submarine. The tow body structure of U.S. Pat. No. 5,406,903 could be used as an antenna carrier structure, and has shown a righting capability that is favorable for successful operation. However, neither of these discloses an arrangement supporting an antenna having an entire 180° hemispherical pattern. One antenna that may be used in the '202 or '903 structures has been developed for operation at the surface of the water and is shown in U.S. Pat. No. 6,127,983 to David Rivera et al. The antenna has an elongate metal cylinder having an longitudinal slot that may be encapsulated in a tow body and towed at the surface of the water, however; the '983 antenna is somewhat large and does not have a complete 180° hemispherical, omni-directional transmission and reception pattern. Furthermore, while the '983 antenna may function satisfactorily in same directions, it has pattern nulls i.e., is blind, in the fore and aft directions.

Thus, in accordance with this inventive concept, a need has been recognized in the state of the art for a low-profile broadband, omni-directional antenna that may be towed by a submarine at the water/air interface to assure reliable communications over a 180° hemispherical pattern.

SUMMARY OF THE INVENTION

The first object of the invention is to provide a low profile antenna towed at the water/air interface by a submarine.

Another object is to provide a low-profile antenna towed by a submarine to provide for different broadband communications.

Another object is to provide a low-profile antenna towed at the surface of the water having a 180° hemispherical radiation/detection pattern of electromagnetic signals in the air.

Another object is to provide a cost-effective antenna of reduced size, complexity and weight to allow for stowage on, deployment from, and retrieval to a submarine.

Another object is to provide a plurality of reliable antennas at the water/air interface each being optionally tunable to one or different bandwidths for selective coverage for a submarine.

Another object of the invention provides a low profile antenna to assure reliable omni-directional communication of electromagnetic signals over a virtual 180° hemispherical pattern.

These and other objects of the invention will become more readily apparent from the ensuing specification when taken in conjunction with the appended claims.

Accordingly, the present invention is an antenna for wide bandwidth transmission and reception of electromagnetic energy signals. The antenna has an elongate semi-cylindrical shell, and a circular end disc is connected to one end, and a semi-circular end disc connected to the other end to form a half-cylinder cavity. A curved plate is connected to the circular end disc and has a curved body portion and a curved end extending parallel with the semi-cylindrical shell. A vertical stem has an upper portion connected to the curved plate. The semi-cylindrical shell, circular end disc, semi-circular end disc, and vertical stem are made from a material that is conductive of electromagnetic signals, and they can be differently dimensioned to change the center frequencies to different broadband ranges.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals refer to like parts and wherein.

DESCRIPTION OF THE PREFERRED EMBODIMENTS

Figure 1:
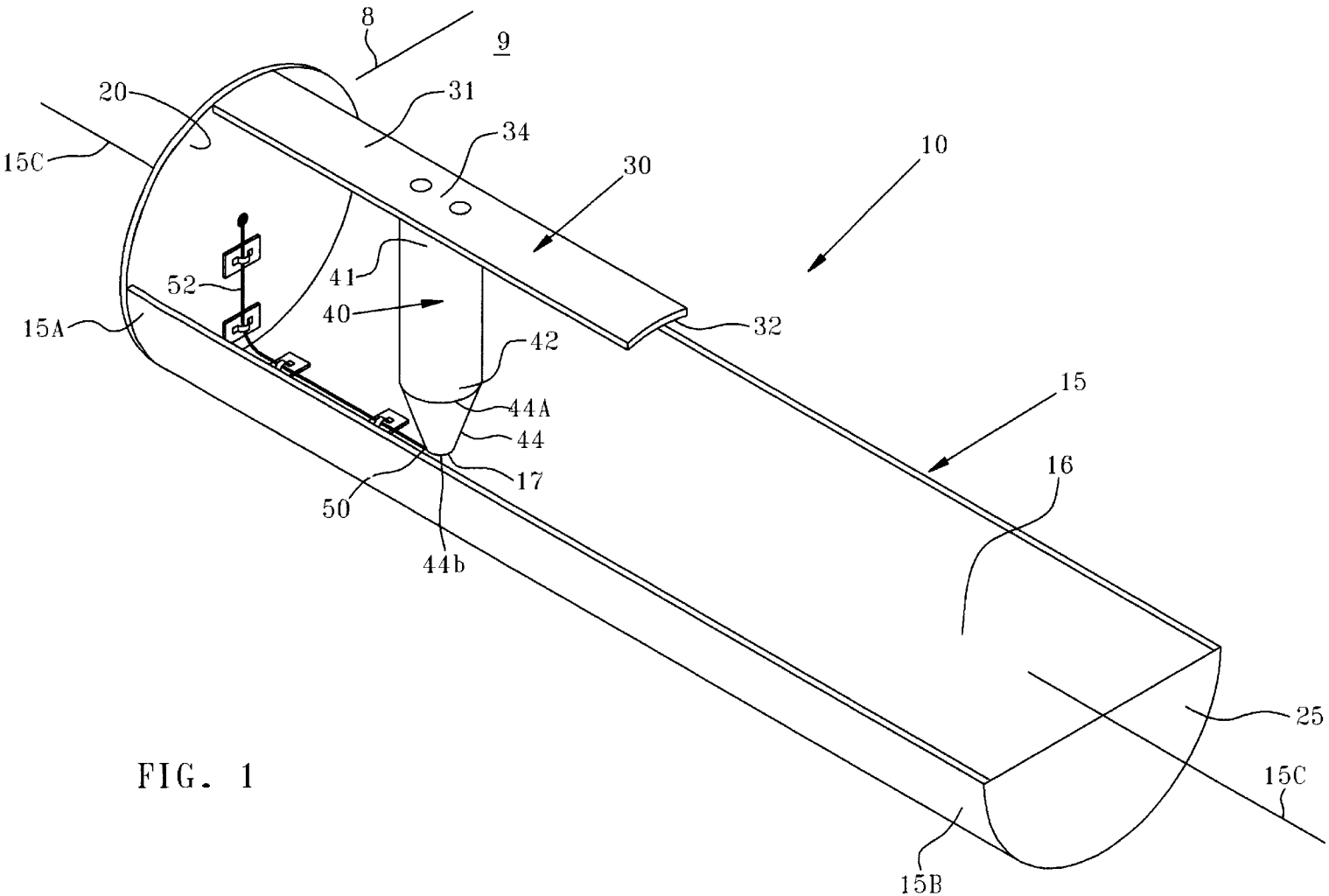
FIG. 1 is an isometric schematic view of the antenna of the invention.

Referring to FIG. 1 of the drawings, antenna 10 of this invention is capable of transmitting and receiving electromagnetic energy signals over a virtually complete 180° hemispherical pattern in air at a surface 8 of a body of water 9. Antenna 10 of the invention has a low profile and can operate over relatively wide bandwidths and be appropriately dimensioned to reduce the problems associated with its stowage, launch, and retrieval in the limited spaces usually found aboard submarines.

Antenna 10 has an elongate one-half-cylinder, or semi-cylindrically-shaped shell 15 between a circularly-shaped end disc 20 at one end 15A and a semi-circularly-shaped end disc 25 at the other end 15B, and a curved plate 30 is connected to end disc 20. Curved plate 30 has a body portion 31 extending parallel with respect to semi-cylindrical shell 15 from end disc 20 above semi-cylindrical shell 15 to an arc-shaped curved end 32. A rod-shaped vertical stem 40 has upper portion 41 connected to body portion 31 of curved plate 30 at connection position 34. Vertical stem 40 has a lower portion 42 coupled to an upper end 44A of a tapered section 44. Lower end 44B of tapered section 44 is connected to semi-cylindrical shell 15 at connection position 17 on semi-cylindrical shell 15. Semi-cylindrical shell 15, circular end disc 20, semi-circular end disc 25 and vertical stem 40 are made from materials that are conductive of electromagnetic signals.

Antenna 10 is capable of wide bandwidth transmission of about 100 MHz about a central frequency having a wavelength λ. This wavelength λdetermines the dimensions of semi-cylindrical shell 15, curved plate 30, and vertical stem 40 and locations of end discs 20, 25. Semi-cylindrical shell 15 in one embodiment of the prototype has been fabricated from a thin sheet of conductive metal of about 0.08 inches in thickness, but may be thicker or thinner. Semi-cylindrical shell 15 was sized to define a half-cylinder cavity 16 having a nominal inside length between metal end discs 20 and 25 of 2λ/5 and a nominal inner diameter of λ/8 on the inside of semi-cylindrical shell 15. The arc subtended by semi-cylindrical shell 15 is nominally 180° with respect to its longitudinal axis 15C, but the arc may be a larger or smaller angle, depending on the desired directional patterns or feedpoint impedance control.

Curved plate 30 may also be thin metal that extends parallel to semi-cylindrical shell 15 and is horizontally oriented during operation on surface 8 of water 9 (including seawater). Curved plate 30 has a length that extends from circular end disc 20 to curved end 32 and is nominally λ/3. The width of curved plate 30 subtends an arc of nominally 40 degrees with respect to longitudinal axis 15C, and the radius of curvature of curved plate 30 can be essentially the same as the curvature of semi-cylindrical shell 15, although the curvature of curved plated 30 can be modified.

Vertical stem 40 is made from conductive metal and has an overall length of nominally λ/8 and a diameter of nominally λ/30. Vertical stem 40 has an upper portion 41 and a lower portion 42, and vertical stem 40 additionally includes a small tapered section 44 at lower portion 42 that is used to connect antenna 10 to a connector port 50. Connector port 50 is coupled to a coaxial cable 52 that extends through circular end disc 20 and onto appropriate driving/monitoring equipment (not shown).

Tapered section 44 can be machined as a truncated cone on vertical stem 40 that measures λ/40 in length. An upper end 44A of tapered section 44 has a diameter of λ/30 to mate with the λ/30 diameter of lower portion 42 of vertical stem 30 above tapered section 44. Lower end 44B of tapered section 44 is machined down to have a diameter of λ/90 where vertical stem 40 is connected to connection place 17 of semi-cylindrical shell 15.

Lower end 44B of tapered section 44 of vertical stem 40 is secured to a connection place 17 on semi-cylindrical shell 15. Upper portion 41 of vertical stem 40 is connected to the underside of curved plate 30 between circular end disc 20 and curved end 32 of curved plate 30 at connection position 34. This securing at connection position 34 is between ½ to ⅔ of the total length of curved plate 30 measured from curved end 32 to vertical stem 40. Vertical stem 40 at lower end 44B can be secured to connection place 17 on semi-cylindrical shell 15, and vertical stem 40 at upper portion 41 can be secured to connection position 34 of curved plate 30 by soldering, brazing, or other secure way that assures an acceptable conductive path.

Figure 2:
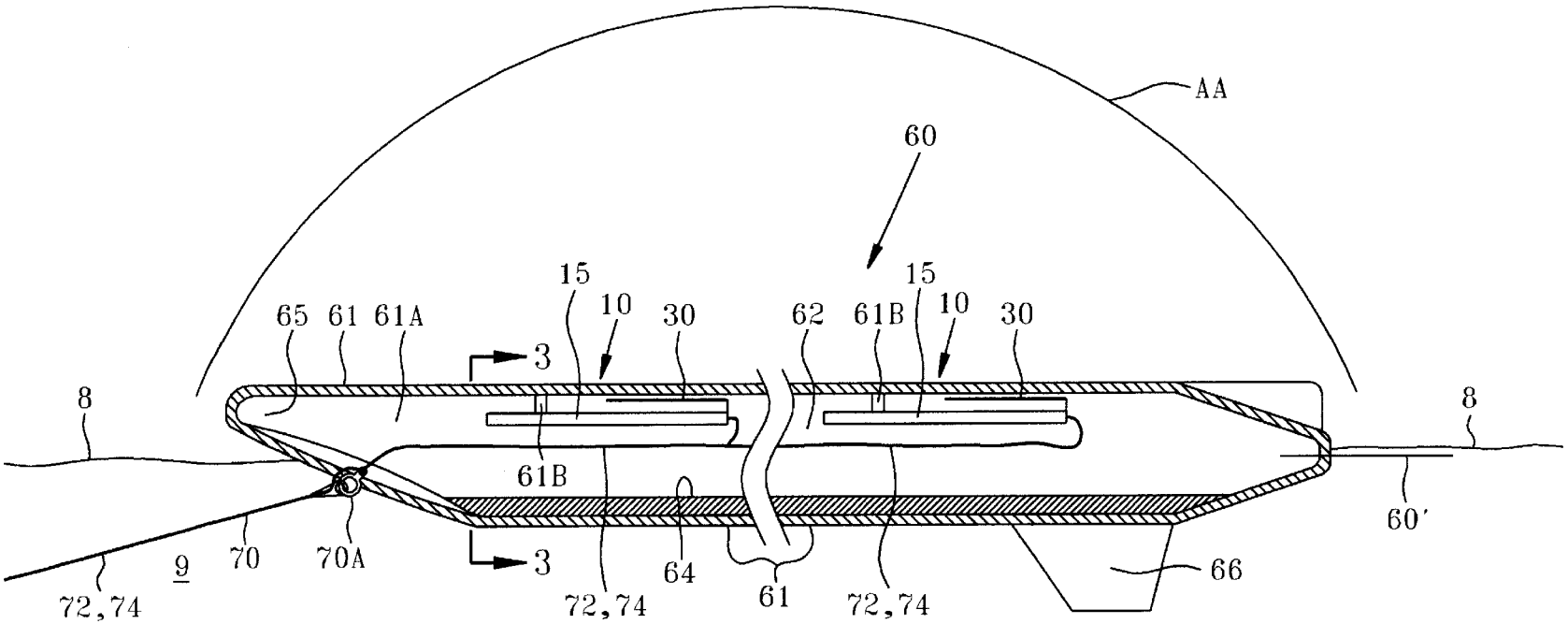
FIG. 2 is a schematic longitudinal cross-sectional view of the antenna in a tow body at the water's surface and of a portion of the hemispherical pattern of transmission and reception of electromagnetic signals in air within a subtended angle of 180° in the fore and aft directions.
Figure 3:
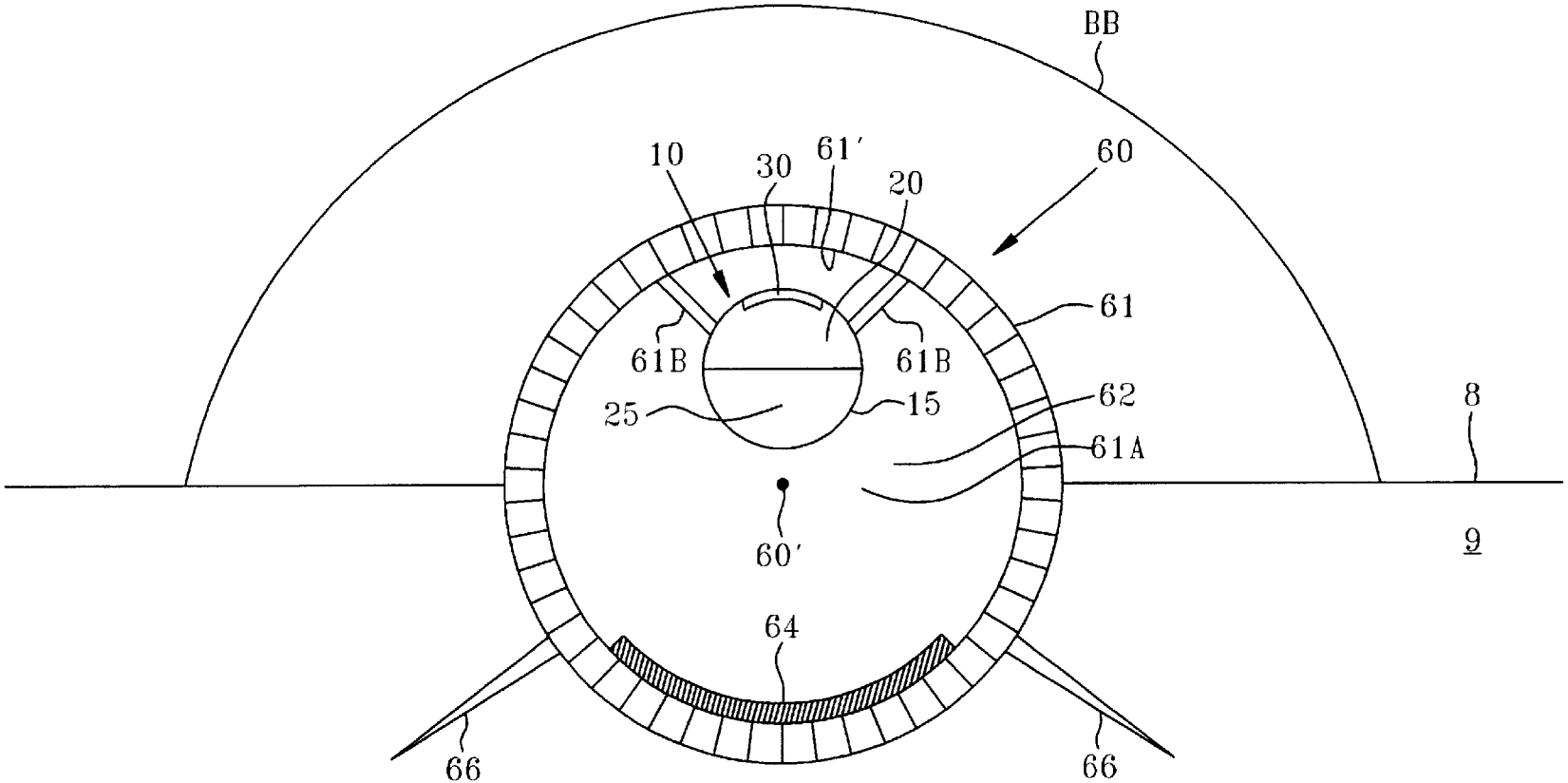
FIG. 3 is a schematic lateral cross-sectional view of the antenna in the tow body taken along line 3—3 in FIG. 2 and of a portion of the hemispherical pattern of transmission and reception of electromagnetic signals in air within a subtended angle of 180° in oppositely extending directions athwart, or abeam.

Referring in addition to FIGS. 2 and 3, elongate tow body 60 can house one or more antennas 10 that are mounted in such a way as to hold antennas 10 at or slightly above surface 8 of ambient seawater 9. Although only two such antennas 10 are shown in FIG. 2, it is understood that any number can be included in tow body 60 depending on the communication needs. Tow body 60 can be made from a non-conducting material, such as fiberglass, and includes an outer shell 61 to seal an interior 61A from ambient water 9. Interior 61A contains suitable internal flotation material 62 such as hollow spheres, syntactic or other foam, air, etc. around antennas 10. Antennas 10 can be mounted on outer shell 61 with non-conducting structural members 61B to position each curved plate 30 of antennas 10 upwardly facing and in a horizontal relationship as tow body is deployed on water 9. Ballast material 64 is disposed at the bottom and along the length of interior 61A and has sufficient weight to keep tow body 60 upright with curved plates 30 upwardly facing and in a horizontal relationship. The combination of flotation material 62 and ballast material 64 positions antennas 10 at or slightly above surface 8 of ambient water 9 and further tends to maintain curved plate 30 of each antenna 10 in an upwardly facing horizontal relationship at or above surface 8.

A flattened nose portion 65 mounted at the fore end of tow body 60 helps divert spray and maintains the horizontal relationship as tow body 60 is being towed on surface 8 of water 9. Stabilizer fins 66 extend from the aft end of tow body 60 to further stabilize the orientation of antennas 10 and maintain the horizontal relationship of each curved plate 30. Reduction of spray helps minimize seawater from washing over tow body 60 that might otherwise result in signal dropouts for antennas 10 as they are being towed by cable 70. Cable 7 is connected to tow body 60 at ring 70A and extends to a towing submarine (not shown). In addition to structural members to bear the load of tow body 60, cable 70 includes power and signal leads 72, 74 extending to coaxial cable 52 of each antenna 10 for interfacing to communications and processing equipment (not shown).

Antennas 10 in tow body 60 are located aft of flattened nose portion 65, and control fins 66 help keep flattened nose portion above surface 8. Since a typical tow body 60 has an inner diameter of about 5.5 inches (the outer diameter is about 5.75 inches), the physically smaller antennas 10 (particularly at frequencies above 1 GHz) can be placed inside of tow body 60. This placement can be asymmetrical with respect to axially extending center 60' of tow body 60 so that each curved plate 30 can be closer to the inside of the top portion 61' of shell 61. Nonconductive mounting structure 61B connects each antenna 10 to shell 61 securely and positions them in tow body 60.

RF energy is fed via conductors 72, 74 of cable 70 and coaxial cable 52 to connector port 50 at lower end 44B of vertical stem 40. With vertical stem 40 so energized, a fraction of the energy reaches horizontal curved plate 30, allowing for current flow along its length. Current flowing along horizontal curved plate 30 then flows toward circular end disc 20 as well as half-cylindrical cavity 16 to generate a hemispherical radiation of RF energy upward and omnidirectionally in air to cover 180° fore and aft as well as oppositely athwart. Current flow, for the most part, is largely confined on the inner surfaces of curved plate 30, end discs 20, 25, and semi-cylindrical shell 15. Very little current flows on the outside of semi-cylindrical shell 15 (the surface "facing" ocean medium (water 9)). Thus, radiation of energy is minimized near the antenna 10/sea surface 9 interface, resulting in greater transmission efficiency. FIG. 2 schematically depicts a portion AA of the hemispherical pattern of transmission and reception of electromagnetic signals in air within a subtended angle of 180° in the fore and aft directions. FIG. 3 schematically depicts a portion BB of the hemispherical pattern of transmission and reception of electromagnetic signals in air within a subtended angle of 180° in oppositely extending directions abeam, or athwart. This hemispherical pattern is created when antenna 10 is placed in buoy 60 on the surface of seawater and operated.

Antenna 10 of the invention is compact and responsive over a broadband of about 100 MHz. This broadband capability of antenna 10 is at least partially due to the antenna's having feedpoint impedance of acceptable levels over a given band. Antenna 10 demonstrated a voltage standing wave ratio (VSWR) of 2:1 or less over a 100 MHz span in the 225–400 MHz military UHF band.

Antenna 10 can be selectively dimensioned to create a desired center frequency about which the broadband response of antenna 10 is centered. For example, if antenna is to be operated at a center frequency of 1500 MHz, the wavelength of the center frequency $\lambda$is 7.87 inches. In accordance with this invention, the length of curved plate 30 would be $\lambda/3$ or 2.6 inches and the width of such a curved plate 30 would be made to subtend an arc of 40 degrees. Experience has demonstrated that the length of curved plate 30 would be slightly shorter for deployment in seawater (closer to 2 inches). Vertical feed stem 40 having an overall length of $\lambda/8$ would be 0.98 inches and would have a diameter of $\lambda/30$ that would be 0.26 inches. The truncated cone shape of tapered section 44 of vertical stem 40 would have a length of 0.20 inches ($\lambda/40$), a diameter at smaller lower end 44A of 0.09 inches ($\lambda$90), and a diameter at larger upper end 44B of 0.26 inches ($\lambda/30$). Half-cylinder cavity 16 would have an inner diameter for semi-cylindrical shell 15 of 0.98 inches ($\lambda/8$), have an inside length between ends 20 and 25 of 3.2 inches ($2\lambda/5$), and semi-cylindrical shell 15 would subtend an arc of 180°. The dimensions of these constituents can be changed to change the center frequency and range of the broadband response. For example, to create a 100 MHz span at a center frequency of 150 MHz, $\lambda$is 10 times larger (78.7 inches) and all dimensions for the constituents of antenna 10 increase by a factor of ten.

A plurality of antennas 10 can be differently dimensioned to cover adjacent overlapping portions throughout a wider spectrum. These differently dimensioned antennas 10 can be placed in a single, longer tow body 60 with their curved plates facing upward in a horizontal relationship to work as an array with much greater bandwidth. Another option is to have a plurality of antennas 10 dimensioned virtually the same and tow them in-line to create forward and rearward beams or be phased when beamed operation in other directions may be desired. As a further option, several separate tow bodies could be arranged tandem or juxtaposed and towed through the water and could be appropriately phased to produce a wide variety of patterns of response.

Antenna 10 of the invention is physically small, allowing for its use as an element in situations where an array of antennas, configured for beam control is wanted. The physical size of each antenna 10 is smaller than contemporary antennas to permit smaller array configurations that could be retrieved in a submerged vessel with fewer complications, and once inside, would require reduced amounts of storage space. The degree of compactness of antenna 10 of the invention is about one-half of the antenna of U.S. Pat. No. 6,127,983 that would create at least a seven inch diameter, forty-eight inch long structure.

Antenna 10 maintains a hemispherical radiation pattern with good gain (+4.5 dBiL where L refers to linear polarization) over substantial angular sectors of the hemisphere.

Antenna 10 is constructed from thin lightweight metal parts that are easily shaped to allow inexpensive fabrication. Antenna 10 may also be blow-molded from plastic and metalized with conductive material to create an ultra-lightweight antenna that minimizes drag while being towed. Antenna 10 also could be made from conductive metaloplastics (metal filled plastics) or conductive polymers.

Changing the shape of horizontal curved plate 30 and half cylinder cavity 16 (semi-cylindrical shell 15) can modify the performance of antenna 10. Tilting or inclining curved plate 30 from the horizontal position modifies, or adjusts the radiation pattern direction. When the unattached curved end 32 of curved plate 30 is tilted, or bent downward toward semi-cylindrical shell 15, radiation is decreased in the upward, or overhead direction and in the direction that extends from curved end 32 and past semi-circular end disc 25. Decreasing the size of the opening of half-cylinder cavity 16 (making semi-cylindrical shell 15 more than a semi-cylinder to span a subtended angle greater than 180°) makes the metallic sector of shell 15 above 180° to decrease radiation athwart and increase it in the plane, or direction extending fore and aft.

The disclosed components and their arrangements of antenna 10, as disclosed herein, all contribute to the novel features of this invention. Antenna 10 of this invention provides a compact, low profile, broadband antenna deployed from a submarine for use at the surface 8 of water 9. Therefore, antenna 10 as disclosed herein is not to be construed as limiting, but rather, is intended to be demonstrative of this inventive concept.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. An antenna for operation at the surface of water, comprising:

an elongate semi-cylindrical shell having a first end and a second end;

a circular end disc connected to said first end;

a semi-circular end disc connected to said second end, said semi-cylindrical shell, said circular end disc and said semi-circular end disc forming a half-cylinder cavity therein;

a curved plate connected to said circular end disc and having a curved body portion and curved end extending parallel with said semi-cylindrical shell; and a vertical stem having an upper portion secured to said curved plate, said semi-cylindrical shell, said circular end disc, said semi-circular end disc, and said vertical stem being made from a material conductive of electromagnetic signals.

2. The antenna of claim 1 wherein said semi-cylindrical shell subtends an arc of nominally 180° with respect to its longitudinal axis.

3. The antenna of claim 2 wherein said semi-cylindrical shell contains a half-cylinder cavity to help assure transmission and reception of a hemispherical pattern of electromagnetic signals.

4. The antenna of claim 3 wherein said transmission and reception of said hemispherical pattern of electromagnetic signals occurs in air within a subtended angle of 180° when operating at the surface on seawater.

5. The antenna of claim 4 wherein said vertical stem further comprises:

a tapered section having a lower end connected to said lower portion of said vertical stem.

6. The antenna of claim 5 further comprising:

a connector port connected to said lower end of said tapered section for conduction of electromagnetic signals.

7. The antenna of claim 6 wherein said vertical stem is secured to a connection position on the underside of said curved body portion between said circular end disc and said curved end.

8. The antenna of claim 7 wherein said connection position is between ½ to ⅔ of the total length of said curved body portion of said curved plate measured from said curved end to said vertical stem.

9. The antenna of claim 8 wherein transmission and reception of electromagnetic signals over a bandwidth of about 100 MHz occurs about a central frequency having a wavelength λ.

10. The antenna of claim 9 wherein said semi-cylindrical shell has an inside length between said circular end disc and said semi-circular end disc nominally equal to 2λ/5 and an inner diameter of nominally λ/8 on the inside of said semi-cylindrical shell.

11. The antenna of claim 10 wherein said curved plate has a length of nominally λ/3 extending from said circular end disc to said curved end, and said curved plate has a width subtending an arc of nominally forty degrees.

12. The antenna of claim 11 wherein said curved plate has a radius of curvature essentially the same as said semi-cylindrical shell.

13. The antenna of claim 12 wherein said vertical stem is made from conductive metal and has an overall length of nominally λ/8 and a diameter of nominally λ/30.

14. The antenna of claim 13 wherein said vertical stem has an overall length of nominally λ/8 and a diameter of nominally λ/30.

15. The antenna of claim 14 wherein said tapered section of said vertical stem is shaped as a truncated cone measuring λ/40 in length having a λ/30 diameter for an upper end to mate with the λ/30 diameter of said vertical stem above said tapered section, and a λ/90 diameter for a lower end of said tapered section where said vertical stem is connected to said semi-cylindrical shell.

16. An antenna system for operation at the surface of water comprising:

an elongate tow body adapted to coupled to a towing cable and having a sealed interior; and at least one antenna disposed in said elongate tow body antenna for operation at water's surface, each antenna having an elongate semi-cylindrical shell having a first end and a second end;

a circular end disc connected to said first end;

a semi-circular end disc connected to said second end, said semi-cylindrical shell, said circular end disc and said semi-circular end disc forming a half-cylinder cavity therein;

a curved plate connected to said circular end disc and having a curved body portion and curved end extending parallel with said semi-cylindrical shell; and a vertical stem having an upper portion connected to said curved plate and a lower portion connected to said semi-cylindrical shell, said semi-cylindrical shell, said circular end disc, said semi-circular end disc, and said vertical stem being made from a material conductive of electromagnetic signals.

17. The antenna system of claim 16 wherein said tow body has flotation materials and ballast materials to help keep each antenna upwardly facing and in a horizontal relationship while deployed on water, and each semi-cylindrical shell subtends an arc of nominally 180° with respect to its longitudinal axis, and each semi-cylindrical shell of each antenna contains a half-cylinder cavity to help assure transmission and reception of a hemispherical pattern of electromagnetic signals within a subtended angle of 180° when operating at the surface on seawater.

18. The antenna system of claim 17 wherein said tow body has a flattened nose portion mounted on its fore end to help divert spray and maintain said horizontal relationship while being towed and stabilizer fins extend from the aft end of tow body 60 to further stabilize the orientation of antennas 10 and maintain said horizontal relationship of each curved plate.

19. The antenna system of claim 18 wherein said vertical stem of each antenna is connected to a connection position on the underside of said curved body portion between said circular end disc and said end of said curved plate, said connection position is between ½ to ⅔ of the total length of said curved body portion of said curved plate measured from said curved end to said vertical stem, and transmission and reception of electromagnetic signals over a bandwidth of about 100 MHz for each antenna occurs about a central frequency having a wavelength λ.

20. The antenna system of claim 19 wherein different antennas are dimensioned differently to have different central frequencies and different bandwidths.

* * * * *

UNITED STATES PATENT AND TRADEMARK OFFICE

CERTIFICATE OF CORRECTION

PATENT NO. : 6,683,579 B1
DATED : January 27, 2004
INVENTOR(S) : David F. Rivera It is certified that error appears in the above-identified patent and that said Letters Patent is hereby corrected as shown below:

Title page,
Item [75], Inventor, reads "Riveria" should read -- Rivera --.

Signed and Sealed this

Eighteenth Day of May, 2004

JON W. DUDAS
*Acting Director of the United States Patent and Trademark Office*